US006835046B2

(12) United States Patent
Strassberger et al.

(10) Patent No.: US 6,835,046 B2
(45) Date of Patent: Dec. 28, 2004

(54) CONFIGURATION OF A COOLABLE TURBINE BLADE

(75) Inventors: Michael Strassberger, München (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 51 days.

(21) Appl. No.: 10/311,935

(22) PCT Filed: Jun. 8, 2001

(86) PCT No.: PCT/EP01/06502

§ 371 (c)(1),
(2), (4) Date: Dec. 20, 2002

(87) PCT Pub. No.: WO01/98634

PCT Pub. Date: Dec. 27, 2001

(65) Prior Publication Data

US 2003/0156943 A1 Aug. 21, 2003

(30) Foreign Application Priority Data

Jun. 21, 2000 (EP) ..... 00113298

(51) Int. Cl.[7] ..... F01D 5/18
(52) U.S. Cl. ..... 416/97 R
(58) Field of Search ..... 415/115; 416/96 R, 416/97 R

(56) References Cited

U.S. PATENT DOCUMENTS 2,641,440 A 6/1953 Williams
2,687,278 A 8/1954 Smith
3,017,159 A 1/1962 Foster
3,885,609 A 5/1975 Frei
4,073,599 A 2/1978 Allen et al.
4,180,373 A 12/1979 Moore et al.
5,462,405 A * 10/1995 Hoff et al. ..... 416/97 R

FOREIGN PATENT DOCUMENTS

EP 0 034 961 2/1981
GB 2152150 A * 7/1985 ..... F02C/7/047

* cited by examiner

*Primary Examiner*—Edward K. Look
*Assistant Examiner*—Richard A. Edgar
(74) *Attorney, Agent, or Firm*—Harness, Dickey & Pierce, P.L.C.

(57) ABSTRACT

A turbine blade through which cooling liquid flows, comprises several flow channels that are adjacently arranged in the flowing-off direction of the working fluid. The flow channels extend between inflow openings, which are located on a radially inner blade foot, and out-flow openings, which are situated opposite the blade foot in a more radially outer manner. The flow channels extend such that the local radial flow components of the resulting cooling fluid stream are directed outward in a, for the most part, predominately radial manner. A flow channel, which is in the front when viewing in the flowing-off direction, is provided whose outflow openings are placed inside a touching edge of the turbine blade. In addition, at least one rear edge channel is provided whose associated resulting cooling fluid stream additionally comprises local cross-flow components and whose outflow openings are placed inside a rear edge of the turbine blade.

36 Claims, 2 Drawing Sheets

CONFIGURATION OF A COOLABLE TURBINE BLADE

This application is the national phase under 35 U.S.C. § 371 of PCT International Application No. PCT/EP00/06502 which has an International filing date of Jun. 8, 2001, which designated the United States of America and which claims priority on European Patent Application number EP 00113298.4 filed Jun. 21, 2000, the entire contents of which are hereby incorporated herein by reference.

FIELD OF THE INVENTION

The invention generally relates to a turbine blade through which cooling fluid flows.

BACKGROUND OF THE INVENTION

A turbine blade, through which cooling fluid flows, has internal flow ducts, which are separated from one another by internal walls. The working fluid flows around the turbine blade. The turbine blade can be a gas turbine blade. The working fluid is then gas. The turbine blade is inclined relative to the approaching working fluid, so that a force component in the peripheral direction of the turbine occurs in the usual manner. The efflux direction of the working fluid is, therefore, essentially that direction along the turbine blade in which the working fluid flows around the latter.

The type mentioned is a turbine blade in the rear region of a turbine. In this location, the working fluid has already expanded and cooled to such an extent that only slightly cooled turbine blades are employed. Thus, only a small flow of cooling fluid through the turbine is provided. Because of the small flow, a meander structure of flow ducts for the cooling fluid does not function satisfactorily in the case of slightly cooled turbine blades. Because of the slow flow velocity of the cooling fluid, the latter would have an excessive cooling effect in the initial region of a meandering flow duct and would be too strongly heated in the final region, in consequence, the cooling effect would be inadequate in that region; in the case of the turbine blades mentioned, the flow velocity of the cooling fluid can also be too low with respect to the centrifugal forces occurring due to the rotation of the turbine.

The cooling fluid therefore only flows in a simple manner along the radial extent of the turbine blade. In the case of simple flow—i.e. in the case of flow ducts with practically no reversal locations relative to the radial direction of the cooling fluid flow—the problems mentioned above do not occur. For this purpose, turbine blades are known which have radial holes or straight radial ducts extending from a radially inner blade root to outlet flow openings located further radially outward—outlet flow openings introduced into the rubbing edge. The resulting cooling fluid flow then has the desired local—at each location of the flow duct—radial flow components which are expediently directed, predominantly to exclusively, radially outward.

Because of the technically determined minimum dimensions of both the cast core and the wall thickness, the flow, and therefore also the cooling effect, is strongly inhomogeneous in such turbine blades. As an example, the region of a trailing edge, which has to become narrower in the efflux direction, can as a rule no longer have a radial flow duct passing through it because of the minimum dimensions mentioned, determined by the manufacturing process. The result is overheating of the overhanging trailing edge. In addition, there are limitations—in particular due to the minimum dimensions mentioned above—to the geometry of the usually large turbine blades in the rear region of the turbine.

SUMMARY OF THE INVENTION

An object of an embodiment of the present invention is to provide a turbine blade which, despite a small cooling fluid flow, is matched in terms of its geometry to the technical requirements for slightly cooled turbine blades and nevertheless permits substantially homogeneous cooling, in particular in the edge zones.

An embodiment of the invention offers the advantage that it permits a homogeneous cooling of the turbine blade, in particular in the region of the edges. The region of the trailing edge duct, in which the aerodynamic requirements demand narrowing of the turbine blade, for example, is particularly problematic in this connection.

The advantage mentioned may be achieved by one or more trailing edge ducts being present whose cooling fluid flow have local transverse flow components at predetermined locations, outlet flow openings being introduced into a trailing edge of the turbine blade for these trailing edge ducts. The use of the trailing edge as the region for the outlet flow of the cooling fluid opens a large variety of design possibilities, which were not previously accessible, for slightly cooled turbine blades.

As an example, the trailing edge ducts can—at least in part—conduct their cooling fluid away via the outlet flow openings which are introduced into the trailing edge. By this, more free space is also created for the ducts located—viewed in the efflux direction—before the trailing edge ducts. Outlet flow openings, particularly on the rubbing edge, admission to which had previously been through the trailing edge ducts, can now be used for conducting away cooling fluid from flow ducts located in front of the trailing edge ducts.

A trebly useful effect is achieved: by this it is, namely, possible for the first time to effectively and homogeneously cool the trailing edge of a turbine blade according to an embodiment of the invention and to have, at the same time, a thin trailing edge (with respect to improved aerodynamics). In addition, a natural efflux of the cooling fluid is achieved for the trailing edge ducts and this also permits the front flow ducts located in front of the trailing edge ducts to be matched, in their geometry and particularly in their efflux behavior, to the technical requirements.

Thus, for example, front flow ducts can provide admission to more outlet flow length along the rubbing edge than was previously the case. Because the trailing edge ducts are, on the one hand, displaced further in the efflux direction toward the trailing edge and, on the other, are deflected due to their bent shape, the front flow ducts located in front of them can fill the resulting free space. Due to the local transverse flow components of the trailing edge ducts, the front flow ducts can likewise be bent in such a way that they also have local transverse flow components. This provides a different space utilization within the cooling volume of the turbine blade, with better utilization of the cooling air.

By this, even turbine blades in the rear region of the turbine—i.e. turbine blades with little cooling—can, for the first time, be embodied with minimum to disappearing limitations with respect to the geometry. It is, for example, an adequately known requirement (for strength reasons and casting reasons) that the turbine blade should become narrower away from the blade root in the radial direction. Because the outlet flow openings of the trailing edge are used, the other flow ducts, in particular the front and central flow ducts, can be extended in this direction in terms of their extent parallel to the efflux direction and, therefore, can compensate for the decrease in thickness in the radial direction by spreading parallel to the efflux direction and utilizing a plurality of the outlet flow openings in the rubbing edge by use of a flow duct. By this, a practically constant internal cross section of the flow ducts can be achieved, at the best possible efficiency of the turbine, in association with a slender profile. This is only possible by use of an embodiment of the invention because the additional space is only made possible by the outlet flow openings now freed on the rubbing edge and by the curved shape of the flow ducts. In addition, a profile shape imposed to optimize the aerodynamics (edge zone effect) is possible—in contrast to drilled blades—with a cooling possibility for the trailing edge, in contrast to previous geometries.

The flow ducts can be shaped in such a way that transverse flow components are present in the efflux direction and opposite to it. Exclusively or predominantly transverse flow components in the efflux direction are, however, preferred. The transverse flow components effect a flow through the trailing edge, which was not previously present. Due to the utilization of the transverse flow components mentioned, furthermore, the cooling fluid is automatically conducted to the outlet flow openings in the trailing edge.

Preference is given to a trailing edge duct and/or a front flow duct which deflect/deflects, at least in sections, from the radial direction in the efflux direction, in particular with their/its outer radial sections.

In order to avoid dead zones and to reduce the flow resistance overall, so that the total cooling volume available is effectively utilized, provision is made for the deflection sections to be rounded. The deflection sections then extend without edges and with curvature.

A plurality of trailing edge ducts can be present. In particular, the last trailing edge duct, viewed in the efflux direction, is provided practically exclusively with outlet flow openings introduced into the trailing edge. On the basis of the inventive idea of utilizing transverse flow components and providing outlet flow openings in the trailing edge, this is the most effective solution and as few outlet flow openings as possible—preferably no outlet flow openings at all—other than those of the trailing edge have fluid admitted to them and are, in consequence, occupied.

The last trailing edge duct can, therefore, also end before the rubbing edge radially inward at a radial distance. According to an embodiment of the invention, this duct needs, namely, no outlet flow openings in the rubbing edge at all. This first permits a particularly effective shaping of the turbine blade—in particular with respect to the efficiency of the turbine.

In addition, a radially continuous trailing edge duct can be present which has both outlet flow openings which are introduced into the rubbing edge and outlet flow openings which are introduced into the trailing edge. Such a radially continuous trailing edge duct forms, more or less, the transition between a front flow duct and a trailing edge duct, which only has outlet flow openings which are introduced into the trailing edge. A gentle transition is achieved by use of such a radially continuous trailing edge duct. The cooling volume available can be effectively utilized by this.

It is then, for example, possible for the last trailing edge duct to have outlet flow openings which are located further radially inward and are introduced into the trailing edge and for the radially continuous trailing edge duct to have outlet flow openings which are located radially further outward and are introduced into the trailing edge. An opening, that is a penetration in the internal region between the two flow ducts, can be provided between the last trailing edge duct and the radially continuous trailing edge duct. The wall between the individual flow ducts, which separates all flow ducts, is then interrupted at the location of the opening. The continuous connection is used to permit casting capability with respect to the core position.

As already stated above, an embodiment of the invention achieves the effect that the local, resultant, effective internal cross section is practically of the same size over the complete length of a flow duct with the exception of negligible cross-sectional deviations relating to the flow resistance of the flow duct. The cross-sectional deviations are preferably less than 20 percent and, in particular, less than 10 percent, of the internal cross section mentioned. The resultant, effective overall cross-sectional area of the inlet flow openings is preferably equal to the overall cross-sectional area of the outlet flow openings of a flow duct, the respective overall cross-sectional area corresponding to the internal cross section of the associated flow duct.

A turbine blade according to an embodiment of the invention has little cooling, i.e. is embodied without the meander structure of the flow ducts. It is used for the rear region of a turbine and/or for turbines/turbine blades with little cooling.

BRIEF DESCRIPTION OF THE DRAWINGS

The invention is explained in more detail using exemplary embodiments represented in the figures. In these.

In the figures, the designations indicate the same design features in each case. The invention is described below with simultaneous reference to FIG. 1 and FIG. 2.

DETAILED DESCRIPTION OF THE PREFERRED EMBODIMENTS

Figure 1:
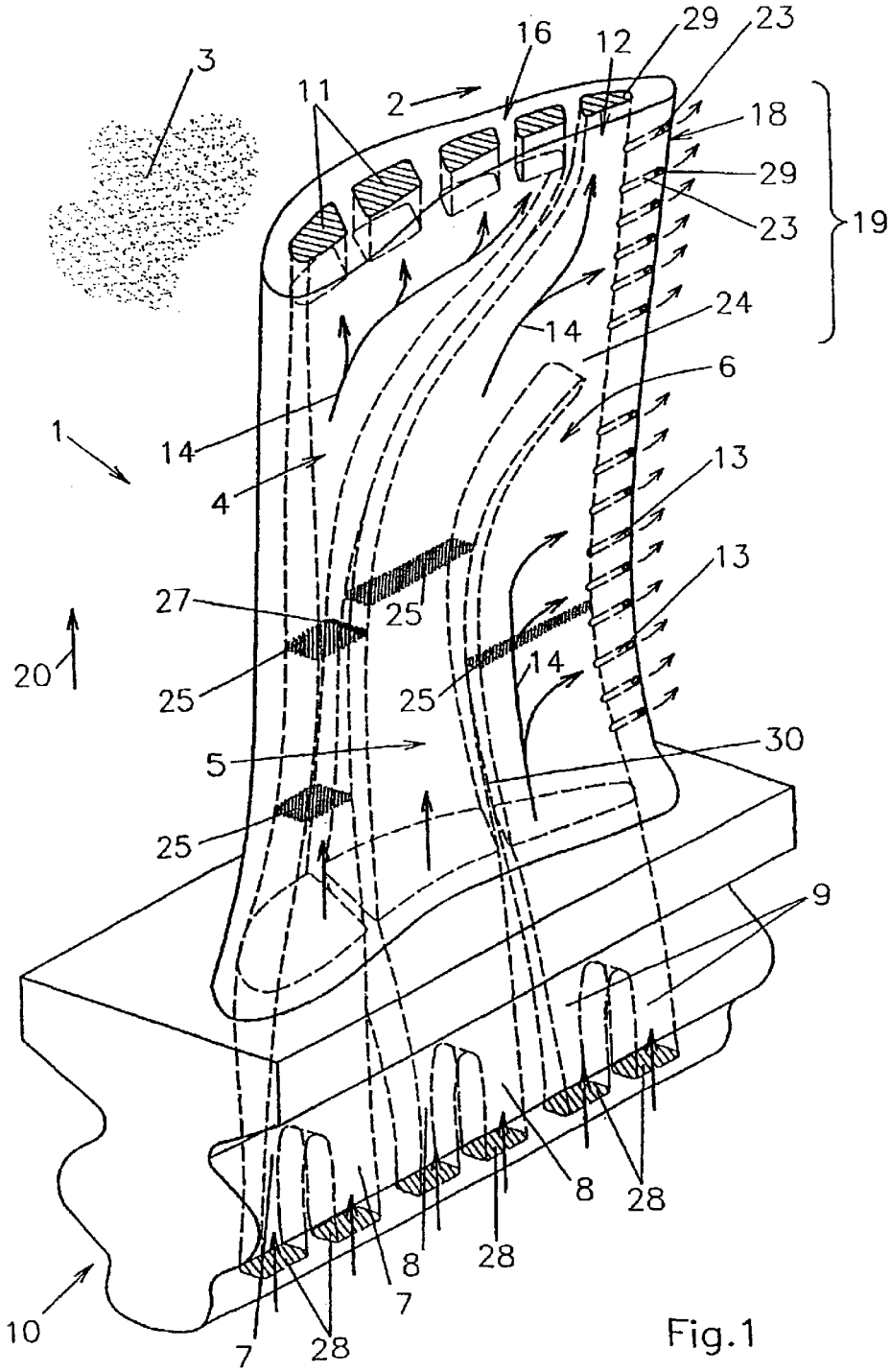
FIG. 1 shows a perspective elevation of a turbine blade according to an embodiment of the invention with blade root, the internally located flow ducts being represented as hidden.

The working fluid 3—which is only represented as an excerpt and as an example in FIG. 1—flows around the turbine blade 1 in the efflux direction 2, the working power being generated, or the turbine driven, by this. The cooling fluid 31—which is likewise shown as an excerpt and as an example in FIG. 2—flows through the turbine blade 1 along the flow ducts 4, 5, 6. The turbine blade 1 is cooled by this. The cooling fluid 31 can, for example, be (cooled) air.

Such a turbine blade 1 has a blade root 10, which is pushed into a corresponding groove of the turbine disk (not shown here) and is fastened there. In this arrangement, the inlet flow openings 7, 8, 9 shown are aligned with corresponding openings in the turbine disk. The cooling fluid 31 is supplied through these to the flow ducts 4, 5, 6.

The flow ducts 4, 5, 6 extend between the inlet flow openings 7, 8, 9 on the radially inner blade root 10 and outlet flow openings 11, 12, 13 located opposite to them and radially further outward. They extend without reversal locations with respect to the radial direction 20, i.e. practically reversal-free. The cooling fluid 31, therefore, only flows simply through the radial extent of the turbine blade 1 in each flow duct 4, 5, 6. At each position of a flow duct, the resulting cooling fluid flow 14 has, locally, practically exclusively radially outwardly directed radial flow components 15—and no approximately radially inwardly directed components (see FIG. 2). All the radial flow components 15 therefore point away from the center of rotation of the turbine. A turbine blade 1, then also has little cooling and is therefore suitable for realizing an embodiment of the invention if its flow ducts have, expediently, substantially radially outwardly directed radial flow components 15.

The flow ducts 4, 5, 6 separated by the inner walls 30 are, in the exemplary embodiment shown, curved in such a way that the resulting cooling fluid flow 14 has local transverse flow components 17 in addition to the radial flow components 15 mentioned.

Figure 2:
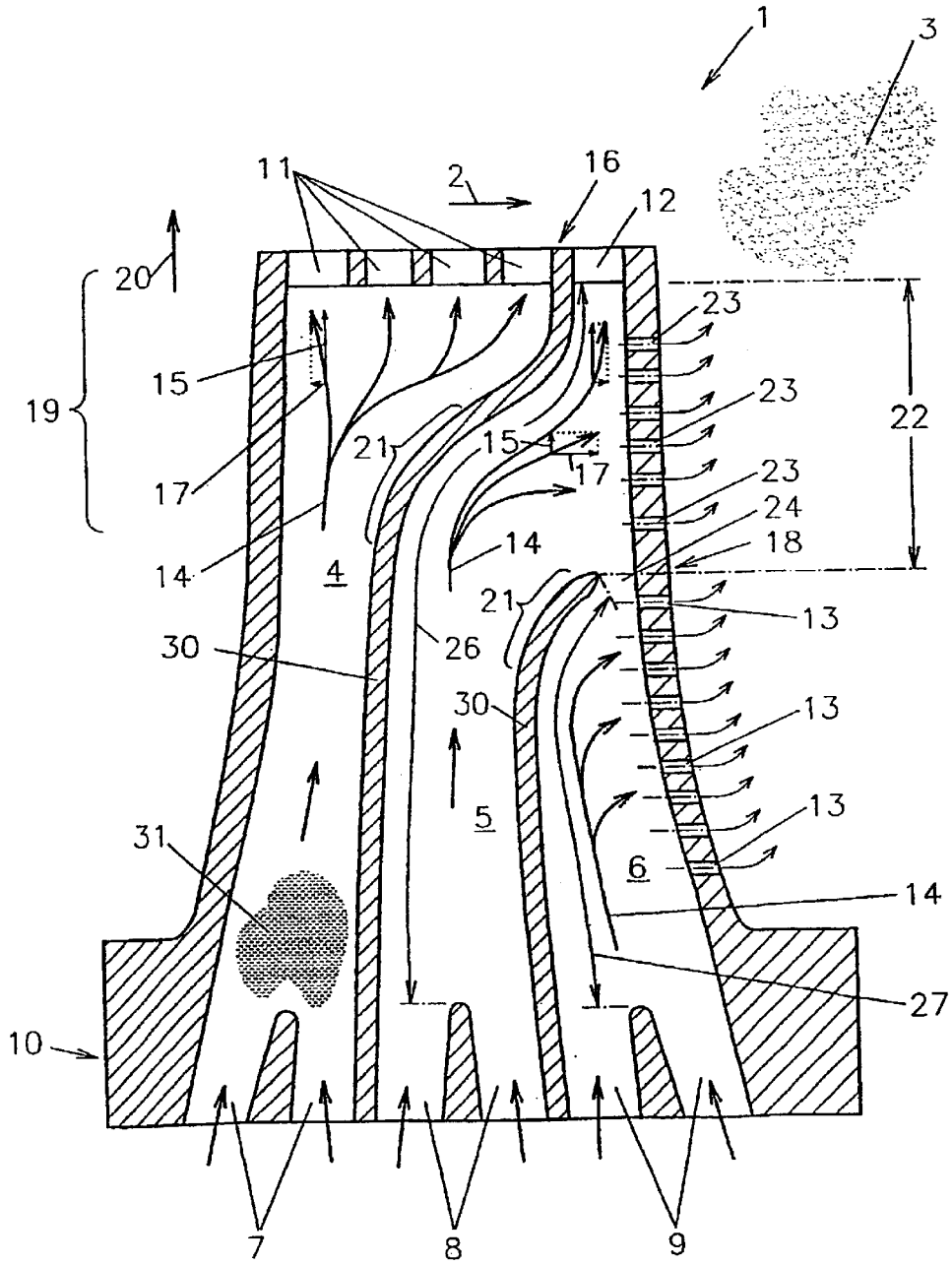
FIG. 2 shows a longitudinal section through the turbine blade of FIG. 1.

For clarification, the resulting cooling fluid flow 14 in the flow ducts 4,5 is diagrammatically resolved in FIG. 2 into, respectively, a radial flow component 15 and a transverse flow component 17. The radial flow components 15 all point radially outward. In consequence, the cooling fluid flow 14 is practically reversal-free with respect to the radial direction 20.

In the exemplary embodiment, this applies to all the flow ducts 4, 5, 6.

A last trailing edge duct 6, viewed in the efflux direction, is present. This trailing edge duct 6 (like the flow ducts 4,5 also) deflects with rounded deflection sections 21 from the radial direction 20 into the efflux direction 2. The shape of the flow duct 6 is therefore curved in the direction toward the trailing edge 18.

Due to the curvature, the transverse flow components 17 are locally directed in the efflux direction 2 at each location. By this, the cooling fluid 31 of the last trailing edge duct 6 is supplied to the outlet flow openings 13 in the trailing edge 18, which outlet flow openings 13 are located further radially inward.

In each of the figures, two trailing edge ducts 5,6 are shown. Both trailing edge ducts 5,6 open into the outlet flow openings 13,23 in the trailing edge 18. The radially continuous trailing edge duct 5 opens into the outlet flow openings 23, which are introduced into the trailing edge 18 and are located radially further outward, and simultaneously into an outlet flow opening 12 introduced into the rubbing edge 16. So that the cooling fluid 31 in the radially continuous trailing edge duct 5 can be admitted to the outlet flow openings 23 located radially further outward, the last trailing edge duct 6, viewed in the efflux direction 2, ends radially inward in front of the rubbing edge 16 at a radial distance 22. In consequence, there is no admission from the last trailing edge duct 6 to the outlet flow openings 23.

The trailing edge ducts 5,6 communicate by way of an opening 24, which is arranged in the center (relative to the radial direction 20) of the radially continuous trailing edge duct 5 and at the radially outer end of the last trailing edge duct 6.

The front flow duct 4, viewed in the efflux direction 2, becomes wider in the radial direction 20 toward the outside with respect to its extent in the efflux direction 2 (i.e. the width). The front flow duct 4 also extends in a curved manner in such a way that local, resultant transverse flow components 17 are present. The inner walls 30, which separate the flow ducts 4, 5, 6 from one another, are of practically the same thickness over the complete radial extent of the turbine blade 1. The shape of the front flow duct 4 therefore follows the trailing edge ducts 5,6 and nestles against these in such a way that the internal space of the turbine blade 1 is practically completely occupied by the flow ducts 4, 5, 6.

Another novel feature of an embodiment of the invention is the fact that the trailing edge ducts 5,6 practically occupy the region of the trailing edge 18 of the turbine blade 1 with the exception of a residual, external wall thickness. This wall thickness—like, also, the size of the casting core of a cast turbine blade, i.e. the size of the hollow spaces—are limited in the downward direction by the technical parameters of the manufacturing process. The occupancy of the trailing edge 18 also provides, overall, a homogeneous cooling, including the trailing edge 18, of the turbine blade 1.

It may be seen, particularly in the perspective representation of FIG. 1, that the turbine blade 1 becomes narrower in the radial direction 20 toward the outside and simultaneously in the efflux direction 2. The internal cross section 25 of the flow ducts 4, 5, 6 should, however, remain approximately the same and, in fact, practically over the complete length 26 of a flow duct 4, 5, 6. This is achieved for the first time, by an embodiment of the invention, for rear region turbine blades 1. In consequence, the local, resultant, effective internal cross section 25 is practically the same size over the complete length 26 of a flow duct 4, 5, 6 with the exception of negligible cross-sectional deviations with respect to the flow resistance of the flow duct 4, 5, 6. This is shown in FIG. 1, with the flow duct 4 as an example.

The area pieces 25 are simply shaded. They are intended to mark an equally large area within a flow duct in each case. In order to clarify the relationships, the areas are not reproduced to scale. The area piece 25 is larger by the cross-sectional deviations 27 in the radial direction 20. The cross-sectional deviation 27 is preferably less than 20 percent, in particular less than 10 percent, of the internal cross section 25. In the radially outer region of the front flow duct 4, where the turbine blade 1 becomes narrower, this internal cross section 25 (not explicitly shown) should also remain the same. In order to achieve this objective, the front flow duct 4 widens in the radial direction 20 toward the outside.

Corresponding area pieces 25 of the trailing edge ducts 5,6 are shown. In these, it may be seen that the turbine blade 1 narrows in the efflux direction 2. Viewed over a flow duct 4, 5, 6, however, the internal cross section 25 should remain practically the same in the radial direction 20, i.e. essentially in the direction of the shape of the respective flow duct 4, 5, 6. This applies to the complete path of the flow fluid 31 within the turbine blade 1 from the blade root 10 to the outlet flow openings 11, 12, 13, 23.

The resulting, effective total cross-sectional area 28 of the inlet flow openings 7, 8, 9 is therefore equal to the total cross-sectional area 29 of the outlet flow openings 11, 12, 13 of a flow duct 4, 5, 6. This total cross-sectional area 28,29 then corresponds approximately to the internal cross section 25 of the associated flow duct 4, 5, 6 with the exception of the deviations mentioned above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine blade, through which cooling fluid flows, comprising:

a plurality of flow ducts adjacently arranged in an efflux direction of the working fluid, the flow ducts extending between inlet flow openings on a radially inner blade root and further radially outwardly located outlet flow openings;

a cooling fluid flow which is practically free of reversal relative to the radial direction;

viewed in the efflux direction, a front flow duct whose outlet flow openings are introduced into a rubbing edge of the turbine blade, wherein at least one trailing edge duct is present whose cooling fluid flow has local transverse flow components at predetermined locations and, for which trailing edge duct, outlet flow openings are introduced into a trailing edge of the turbine blade; and wherein the resultant, effective overall cross-sectional area of the inlet flow openings is equal to the overall cross-sectional area of the outlet flow openings of a flow duct, and wherein the respective overall cross-sectional area corresponds to the internal cross section.

2. A turbine comprising a turbine blade as claimed in claim 1 for the rear region of a turbine and/or for a turbine with little cooling.

3. The turbine blade as claimed in claim 1, wherein at least one of a trailing edge duct and a front flow duct deflects, at least in its outer radial sections, from the radial direction in the efflux direction.

4. A turbine comprising a turbine blade as claimed in claim 1 for the rear region of a turbine.

5. A turbine comprising a turbine blade as claimed in claim 1 for a turbine with little cooling.

6. The turbine blade as claimed in claim 1, wherein a plurality of trailing edge ducts are present.

7. The turbine blade as claimed in claim 1, wherein at least one of a trailing edge duct and a front flow duct deflects, at least in sections, from the radial direction in the efflux direction.

8. The turbine blade as claimed in claim 3, wherein rounded deflection sections are present.

9. The turbine blade as claimed in claim 1, wherein a radially continuous trailing edge duct is present which includes both outlet flow openings introduced into the rubbing edge and outlet flow openings introduced into the trailing edge.

10. The turbine blade as claimed in claim 9, wherein the last trailing edge duct includes radially inwardly located outlet flow openings, introduced into the trailing edge, and wherein the radially continuous trailing edge duct includes outlet flow openings, located radially further outward and introduced into the trailing edge.

11. The turbine blade as claimed in claim 1, wherein the local, resultant, effective internal cross section is practically of the same size over the complete length of a flow duct, with the exception of negligible cross-sectional deviations relating to the flow resistance of the flow duct.

12. The turbine blade as claimed in claim 11, wherein the cross-sectional deviations are less than 20 percent of the internal cross section.

13. The turbine blade as claimed in claim 11, wherein the cross-sectional deviations are less than 10 percent of the internal cross section.

14. The turbine blade as claimed in claim 1, wherein, the last trailing edge duct viewed in the efflux direction, includes outlet flow openings introduced exclusively into the trailing edge.

15. The turbine blade as claimed in claim 14, wherein the last trailing edge duct includes radially inwardly located outlet flow openings, introduced into the trailing edge, and wherein a radially continuous trailing edge duct includes outlet flow openings, located radially further outward and introduced into the trailing edge.

16. The turbine blade as claimed in claim 14, wherein the last trailing edge duct ends before the rubbing edge radially inward at a radial distance.

17. The turbine blade as claimed in claim 16, wherein the last trailing edge duct includes radially inwardly located outlet flow openings, introduced into the trailing edge, and wherein a radially continuous trailing edge duct includes outlet flow openings, located radially further outward and introduced into the trailing edge.

18. The turbine blade as claimed in claim 1, wherein the transverse flow components are present in the efflux direction.

19. A turbine comprising a turbine blade as claimed in claim 18.

20. A turbine comprising a turbine blade as claimed in claim 18 for the rear region of a turbine.

21. A turbine comprising a turbine blade as claimed in claim 18 for a turbine with little cooling.

22. The turbine blade as claimed in claim 18, wherein at least one of a trailing edge duct and a front flow duct deflects, at least in sections, from the radial direction in the efflux direction.

23. The turbine blade as claimed in claim 18, wherein a plurality of trailing edge ducts are present.

24. The turbine blade as claimed in claim 18, wherein, the last trailing edge duct viewed in the efflux direction, includes outlet flow openings introduced exclusively into the trailing edge.

25. The turbine blade as claimed in claim 24, wherein the last trailing edge duct ends before the rubbing edge radially inward at a radial distance.

26. A turbine blade, through which cooling fluid flows, comprising:

a plurality of flow ducts adjacently arranged in an efflux direction of the working fluid, the flow ducts extending between inlet flow openings on a radially inner blade root and further radially outwardly located outlet flow openings;

a cooling fluid flow which is practically free of reversal relative to the radial direction;

viewed in the efflux direction, a front flow duct whose outlet flow openings are introduced into a rubbing edge of the turbine blade, wherein at least one trailing edge duct is present whose cooling fluid flow has local transverse flow components at predetermined locations and, for which trailing edge duct, outlet flow openings are introduced into a trailing edge of the turbine blade;

wherein the resultant, effective overall cross-sectional area of the inlet flow openings is equal to the overall cross-sectional area of the outlet flow openings of a flow duct, and wherein the respective overall cross-sectional area corresponds to the internal cross section, wherein, the last trailing edge duct viewed in the efflux direction, includes outlet flow openings introduced exclusively into the trailing edge, wherein the last trailing edge duct includes radially inwardly located outlet flow openings, introduced into the trailing edge, and wherein a radially continuous trailing edge duct includes outlet flow openings, located radially further outward and introduced into the trailing edge, and wherein the last trailing edge duct communicates with the radially continuous trailing edge duct by way of an opening.

27. A turbine blade, through which cooling fluid flows, comprising:

a plurality of flow ducts adjacently arranged in a flow-off direction of the working fluid and adapted to run between inflow orifices on a radially inner blade root and outflow orifices lying radially outwardly of the inflow orifices;

a cooling fluid flow which is virtually reversal free relative to the radial direction;

a front flow duct, viewed in the flow-off direction, whose outflow orifices are introduced into a leading edge of the turbine blade;

at least one trailing edge duct, whose cooling fluid flow includes, at predetermined points, local transverse flow components parallel to the flow-off direction and in which outflow orifices are introduced into a trailing edge of the turbine blade, wherein a resulting effective overall cross-sectional area of the inflow orifices is equal to an overall cross-sectional area of the outflow orifices of a flow duct and wherein the respective overall cross-sectional area corresponds to the inner cross section and the circumferential shape of a cross section of a flow duct changes over its entire length, wherein a radially continuous trailing edge duct is present, including outflow orifices in the rubbing edge and the trailing edge, and wherein, the last trailing edge duct communicates via an orifice, with the radially continuous trailing edge duct.

28. A turbine blade, through which cooling fluid flows, comprising:

a plurality of flow ducts adjacently arranged in a flow-off direction of the working fluid and adapted to run between inflow orifices on a radially inner blade root and outflow orifices lying radially outwardly of the inflow orifices;

a cooling fluid flow which is virtually reversal free relative to the radial direction;

a front flow duct, viewed in the flow-off direction, whose outflow orifices are introduced into a leading edge of the turbine blade; and at least one trailing edge duct, whose cooling fluid flow includes, at predetermined points, local transverse flow components parallel to the flow-off direction and in which outflow orifices are introduced into a trailing edge of the turbine blade, wherein a resulting effective overall cross-sectional area of the inflow orifices is equal to an overall cross-sectional area of the outflow orifices of a flow duct and wherein the respective overall cross-sectional area corresponds to the inner cross section and the circumferential shape of a cross section of a flow duct changes over its entire length, wherein, the last trailing edge duct communicates via an orifice, with a radially continuous trailing edge duct.

29. A turbine blade, through which cooling fluid flows, comprising:

a plurality of flow ducts adjacently arranged in a flow-off direction of the working fluid and adapted to run between inflow orifices on a radially inner blade root and outflow orifices lying radially outwardly of the inflow orifices;

a cooling fluid flow which is virtually reversal free relative to the radial direction;

a front flow duct, viewed in the flow-off direction, whose outflow orifices are introduced into a leading edge of the turbine blade; and at least one trailing edge duct, whose cooling fluid flow includes, at predetermined points, local transverse flow components parallel to the flow-off direction and in which outflow orifices are introduced into a trailing edge of the turbine blade, wherein a resulting effective overall cross-sectional area of the inflow orifices is equal to an overall cross-sectional area of the outflow orifices of a flow duct and wherein the respective overall cross-sectional area corresponds to the inner cross section and the circumferential shape of a cross section of a flow duct changes over its entire length.

30. A turbine, including the turbine blade of claim 29.

31. The turbine of claim 30, wherein the turbine blade is used in a relatively rear region of the turbine.

32. The turbine of claim 30, wherein the turbine is one with relatively little cooling.

33. The turbine blade as claimed in claim 29, wherein a radially continuous trailing edge duct is present, including outflow orifices in the rubbing edge and the trailing edge.

34. A turbine, including the turbine blade of claim 33.

35. The turbine of claim 34, wherein the turbine blade is used in a relatively rear region of the turbine.

36. The turbine of claim 34, wherein the turbine is one with relatively little cooling.

* * * * *